US012207768B2

(12) United States Patent
Donofrio

(10) Patent No.: US 12,207,768 B2
(45) Date of Patent: Jan. 28, 2025

(54) FOLDING FOOT STOOL FOR ATTACHMENT TO A TOILET

(71) Applicant: Valerie Donofrio, Northport, NY (US)

(72) Inventor: Valerie Donofrio, Northport, NY (US)

(73) Assignee: Valerie Donofrio, Northport, NY (US)

( * ) Notice: Subject to any disclaimer, the term of this patent is extended or adjusted under 35 U.S.C. 154(b) by 10 days.

(21) Appl. No.: 17/879,149

(22) Filed: Aug. 2, 2022

(65) Prior Publication Data

US 2024/0041275 A1 Feb. 8, 2024

(51) Int. Cl.
*A47K 17/02* (2006.01)
*A47K 13/26* (2006.01)

(52) U.S. Cl.
CPC ..... *A47K 17/028* (2013.01); *A47K 13/26* (2013.01)

(58) Field of Classification Search
CPC ..... A47K 17/02; A47K 17/028; A47C 16/02; A47C 16/025; A47C 16/04; A47C 1/034; A47C 1/307; A47C 7/50; A47C 7/52; A47C 7/5066
USPC ..... D6/353
See application file for complete search history.

(56) References Cited

U.S. PATENT DOCUMENTS 4,635,303 A * 1/1987 Shih ..... G09B 19/0076 4/235
4,991,908 A 2/1991 Krechel
D347,945 S 6/1994 Walters-Leiter
D579,680 S 11/2008 Emert
D652,222 S 1/2012 Edwards
8,607,369 B1 12/2013 Al-Khattaf
D766,604 S 9/2016 Edwards
D787,845 S 5/2017 Edwards
D787,846 S 5/2017 Naik
D813,560 S 3/2018 Zioni
D834,342 S 11/2018 Naik
10,561,553 B2 2/2020 Sears
10,588,471 B2 3/2020 Naik et al.
10,694,859 B1 6/2020 Wickland
D897,125 S 9/2020 Baptiste
10,881,256 B1 * 1/2021 Luque, Jr. ..... A47K 17/028
2004/0231918 A1 11/2004 Meeker
2005/0187074 A1 8/2005 Barr
2006/0103219 A1 5/2006 Sardana
2010/0187041 A1 7/2010 Crouch
(Continued)

FOREIGN PATENT DOCUMENTS

CN 110602971 A 12/2019
CN 111387863 A * 7/2020
(Continued)

*Primary Examiner* — Erin Deery
(74) *Attorney, Agent, or Firm* — Sorell, Lenna & Schmidt, LLP

(57) ABSTRACT

A foot stool includes a base having a first panel and a second panel rotatably coupled to the first panel. A step includes a third panel rotatably coupled to the second panel and a fourth panel rotatably coupled to the third panel. A connector is coupled to the first panel and is configured for coupling the base to a toilet bowl. The foot stool is movable from a first configuration in which the first and third panels extend substantially parallel to one another and the second and fourth panels each extend transverse to the first and third panels and a second configuration in which the panels each extend substantially parallel to one another.

19 Claims, 7 Drawing Sheets

(56) References Cited

U.S. PATENT DOCUMENTS

| | | | | |
|---|---|---|---|---|
| 2013/0067649 | A1 | 3/2013 | Rane | |
| 2013/0318698 | A1* | 12/2013 | Schilpp | A47K 17/02 4/254 |
| 2014/0131138 | A1 | 5/2014 | Simpson et al. | |
| 2015/0327739 | A1 | 11/2015 | Edwards et al. | |
| 2018/0078040 | A1* | 3/2018 | Mubarak | A47C 3/16 |

FOREIGN PATENT DOCUMENTS

| | | | |
|---|---|---|---|
| EP | 3424386 | A1 | 1/2019 |
| GB | 2575646 | A | 1/2020 |
| JP | 2004337225 | A | 12/2004 |
| JP | 3123972 | U | 8/2006 |
| KR | 200337248 | Y1 | 1/2004 |
| KR | 200355599 | Y1 | 7/2004 |
| KR | 200434792 | Y1 | 12/2006 |
| KR | 200460173 | Y1 | 5/2012 |
| KR | 101803369 | B1 | 11/2017 |
| KR | 200487119 | Y1 | 8/2018 |
| KR | 200489676 | Y1 | 7/2019 |
| KR | 200490345 | Y1 | 10/2019 |
| KR | 200494548 | Y1 | 11/2021 |
| KR | 102362680 | B1 | 2/2022 |
| WO | 2016201072 | A1 | 12/2016 |
| WO | 2017218784 | A1 | 12/2017 |
| WO | 2019217728 | A1 | 11/2019 |
| WO | 2020037000 | A1 | 2/2020 |

* cited by examiner

FOLDING FOOT STOOL FOR ATTACHMENT TO A TOILET

TECHNICAL FIELD

The present disclosure generally relates to foot stools for attachment to a toilet and more particularly to foot stools for attachment to a toilet that are capable of folding for compact storage when not in use.

BACKGROUND

Foot stools have been manufactured that allow a user to rest their feet upon the foot stool in order to position his or her body in a squatting position to improve bowel and/or bladder evacuation. However, conventional foot stools that have been adapted for use with toilets lack a means to attach the foot stool to a toilet in order to prevent relative movement between the foot stool and the toilet. As a result, the foot stool may be unintentionally kicked or moved during use such that it is no longer functional. Additionally, many conventional foot stools lack a means to fold or otherwise reduce the size of the foot stool to facilitate storage of the foot stool when not in use. Because many bathrooms lack a closet or other space where the unfolded foot stool can be stored, the unfolded foot stool is thus often left adjacent to the toilet, which some may find aesthetically unpleasing. This disclosure describes an improvement over these prior art technologies.

SUMMARY

In one embodiment, in accordance with the principles of the present disclosure, a foot stool is provided that comprises a base including a first panel and a second panel rotatably coupled to the first panel. A step comprises a third panel rotatably coupled to the second panel and a fourth panel rotatably coupled to the third panel. A connector is coupled to the first panel and is configured for coupling the base to a toilet bowl. The foot stool is movable from a first configuration in which the first and third panels extend substantially parallel to one another and the second and fourth panels each extend transverse to the first and third panels and a second configuration in which the panels each extend substantially parallel to one another In one embodiment, in accordance with the principles of the present disclosure, a foot stool system comprises a toilet bowl and a foot stool. The foot stool includes a base comprising a first panel and a second panel rotatably coupled to the first panel by at least one first hinge. The first panel comprises spaced apart first and second sections that are each coupled to the second panel. A step comprises a third panel rotatably coupled to the second panel by at least one second hinge and a fourth panel rotatably coupled to the third panel by at least one third hinge. Spaced apart first straps each connect the first and third panels and spaced apart second straps each connect the third and fourth panels. A first connector is coupled to the first section and a second connector is coupled to the second section. The connectors each provisionally couple the base to the toilet bowl. The connectors each comprise a mount coupled directly to the first panel and a suction cup rotatably coupled to the mount such that the suction cups each form a ball and socket joint with one of the mounts. The foot stool is movable from a first configuration in which the first and third panels extend substantially parallel to one another and the second and fourth panels each extend transverse to the first and third panels and a second configuration in which the panels each extend substantially parallel to one another. The foot stool is configured to move between the first and second configurations when the base is uncoupled from the toilet. The straps are configured to maintain the foot stool in the first configuration.

In one embodiment, in accordance with the principles of the present disclosure, a foot stool system comprises a toilet bowl and a foot stool. The foot stool includes a base comprising a first panel and a second panel rotatably coupled to the first panel by at least one first hinge. The first panel comprises spaced apart first and second sections that are each coupled to the second panel. A step comprises a third panel rotatably coupled to the second panel by at least one second hinge and a fourth panel rotatably coupled to the third panel by at least one third hinge. Spaced apart first straps each connecting the first and third panels and spaced apart second straps each connecting the third and fourth panels. A first connector is coupled to the first section and a second connector is coupled to the second section. The connectors each provisionally couple the base to the toilet bowl. The connectors each comprise a substrate made of a deformable material that is configured to adhere to the toilet bowl. The substrates are each wedge-shaped. The foot stool is movable from a first configuration in which the first and third panels extend substantially parallel to one another and the second and fourth panels each extend transverse to the first and third panels and a second configuration in which the panels each extend substantially parallel to one another. The foot stool is configured to move between the first and second configurations when the base is uncoupled from the toilet. The straps are configured to maintain the foot stool in the first configuration.

BRIEF DESCRIPTION OF THE DRAWINGS

The present disclosure will become more readily apparent from the specific description accompanied by the following drawings, in which.

DETAILED DESCRIPTION

The present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. Also, in some embodiments, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a foot stool system that includes a foot stool adapted to be coupled to a toilet when in use and to be folded for storage when not in use. Alternate embodiments are also disclosed. Reference is made in detail to the exemplary embodiments of the present disclosure, which are illustrated in the accompanying figures. Turning to FIGS. 1-18, there are illustrated components of a foot stool system 20.

Figure 1:
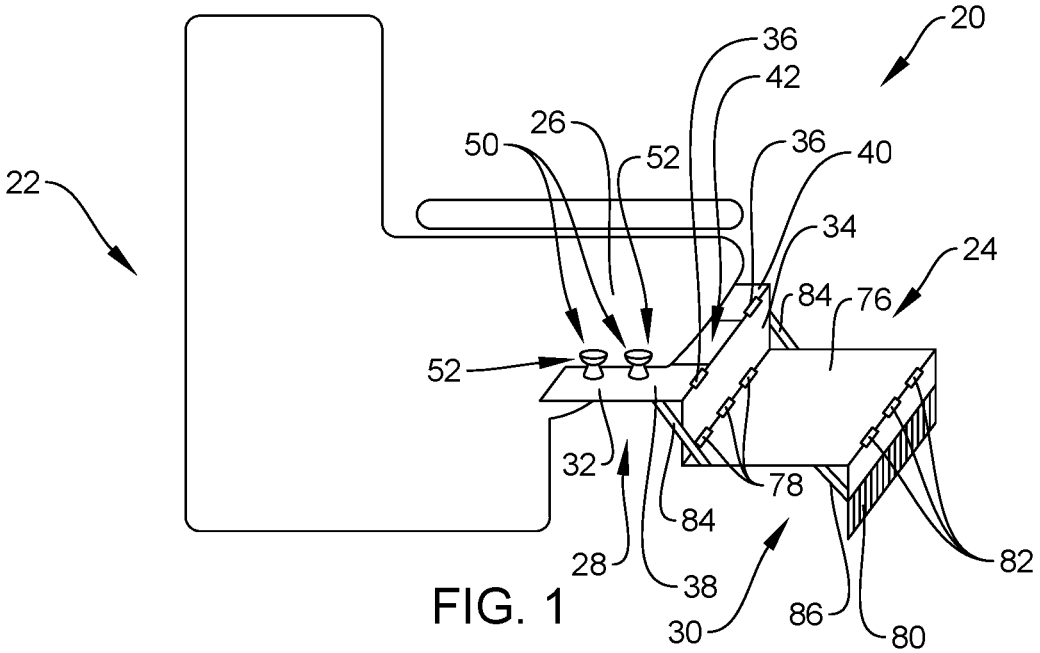
FIG. 1 is a perspective view of a foot stool system including a toilet and a foot stool coupled to the toilet, in accordance with the principles of the present disclosure.

System 20 includes a toilet 22 and a foot stool 24 configured to attach to a bowl 26 of toilet 22. Foot stool 24 is configured to be directly coupled to a portion of toilet 22, such as, for example, bowl 26 of toilet 22, as shown in FIG. 1, such that a user can rest her or her feet on foot stool 24 when sitting upon toilet 22 in order to position his or her body in a squatting position to improve bowel and/or bladder evacuation. Because foot stool 24 is attached directly to toilet 22, relative movement between foot stool 24 and toilet 22 is prevented during use. Foot stool 24 is further adapted to be moved between a first configuration, such as, for example, an expanded or unfolded configuration and a second configuration, such as, for example an unexpanded or folded configuration. It is envisioned that foot stool 24 may be moved from the unexpanded or folded configuration to the expanded or unfolded configuration for use with toilet 22 and then moved from the expanded or unfolded configuration to the unexpanded or folded configuration following use with toilet 22 to facilitate concealment and/or storage of foot stool 24, as discussed herein.

Figure 2:
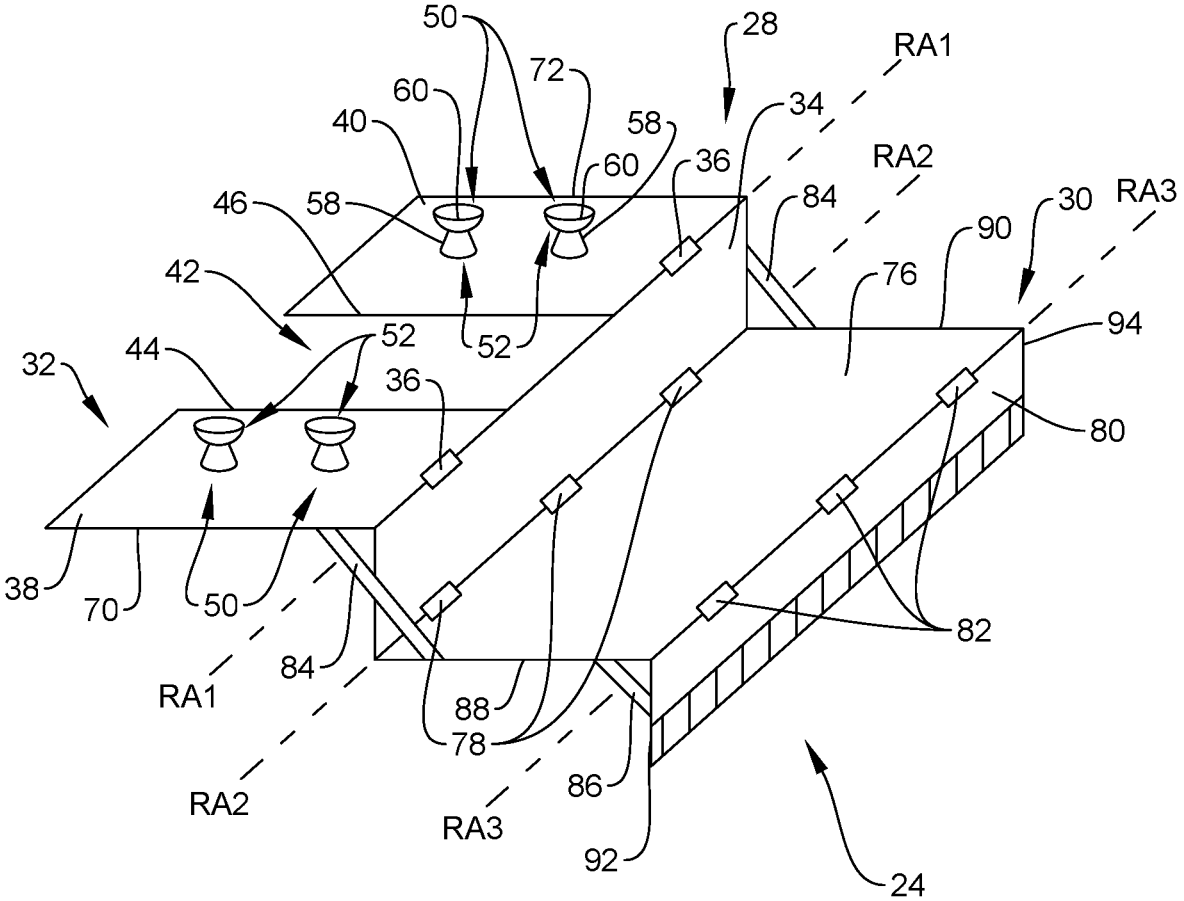
FIG. 2 is a perspective view of one embodiment of the foot stool shown in FIG. 1, in accordance with the principles of the present disclosure.
Figure 3:
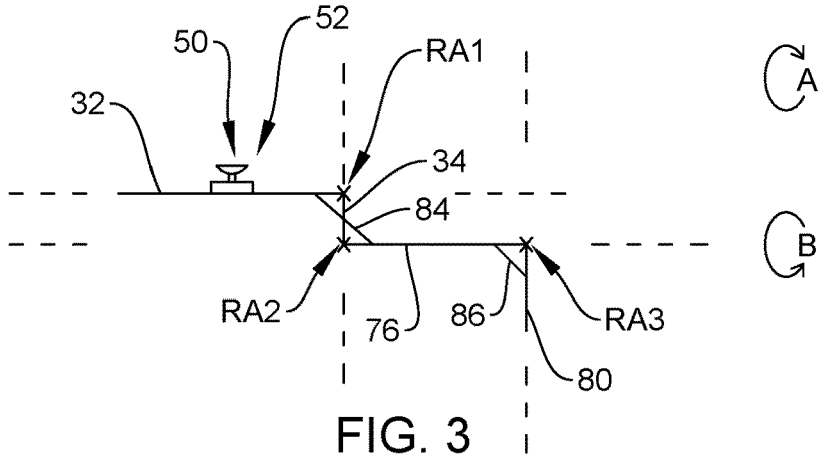
FIG. 3 is a side view of one embodiment of the foot stool shown in FIG. 1, in accordance with the principles of the present disclosure.
Figure 4:
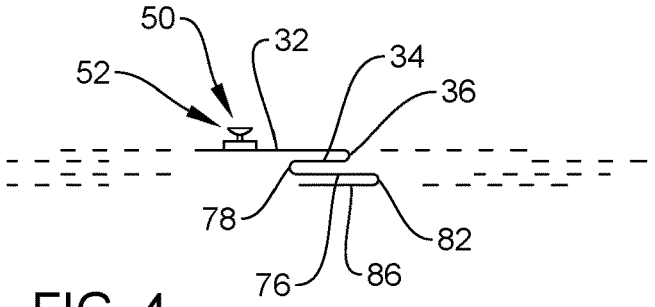
FIG. 4 is a side view of one embodiment of the foot stool shown in FIG. 1, in accordance with the principles of the present disclosure.

Foot stool 24 includes a base 28 configured to be coupled directly to toilet 22 and a step 30 rotatably coupled to base 28. Base 28 includes a first panel 32 and a second panel 34 rotatably coupled to panel 32 by a first hinge 36. Hinge 36 connects panel 34 with panel 32 such that panel 34 is rotatable relative to panel 32 about a rotation axis RA1 defined by hinge 36, as shown in FIG. 2, for example. In particular, panel 34 is rotatable relative to panel 32 via hinge 36 in a first rotational direction about axis RA1, such as, for example, the direction shown by arrow A in FIG. 3 and in an opposite second rotational direction about axis RA1, such as, for example, the direction shown by arrow B in FIG. 3 to move foot stool 24 between the expanded or unfolded configuration, as shown in FIGS. 2 and 3, and the unexpanded or folded configuration, as shown in FIG. 4. In some embodiments, hinge 36 includes only one hinge. In some embodiments, hinge 36 includes a plurality of hinges. In some embodiments, hinge 36 includes a plurality of spaced apart hinges. In some embodiments wherein hinge 36 includes a plurality of hinges, hinges 36 are uniformly spaced apart from one another. In some embodiments, panel 34 is spaced apart from panel 32 such that no portion of panel 34 directly engages panel 32 and panel 34 is connected to panel 32 only by hinge 36. In some embodiments, panel 34 directly engages panel 32 and panel 34 and is further connected to panel 32 by hinge 36. In some embodiments, hinge 36 can be variously connected with panel 32 and/or panel 34, such as, for example, monolithic, integral connection, frictional engagement, threaded engagement, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

Panel 32 includes a first section 38 and a second section 40 that is spaced apart from section 38 to define a recess 42 therebetween. In some embodiments, section 38 and/or section 40 are each coupled to panel 34 by one or a plurality of hinges 36. Recess 42 is sized and shaped to fit bowl 26 of toilet 22 therein, as shown in FIG. 1. In some embodiments, recess 42 is variously shaped, such as, for example, oval, oblong, triangular, rectangular, square, polygonal, irregular, uniform, non-uniform, offset, staggered, undulating, arcuate, variable and/or tapered. In some embodiments, all or a portion of an inner surface 44 of section 38 and/or all or a portion of an inner surface 46 of section 40 may include an elastomeric and/or deformable material that clings and/or adheres to glass and/or porcelain to secure foot stool 24 to bowl 26 when surfaces 44, 46 engage bowl 26. For example, all or a portion of surface 44 may be made of the elastomeric and/or deformable material and/or all or a portion of surface 46 may be made of the elastomeric and/or deformable material. Alternatively, all or a portion of surface 44 may be coated with the elastomeric and/or deformable material and/or all or a portion of surface 46 may be coated the elastomeric and/or deformable material. In some embodiments, panel 32 is made from a non-elastomeric and/or non-deformable material and a gasket that is made of the elastomeric and/or deformable material is applied to all or a portion of surface 44 and/or a gasket that is made of the elastomeric and/or deformable material is applied to all or a portion of surface 46 such that surfaces 44, 46 are spaced apart from bowl 26 by the gaskets when foot stool 24 is coupled to toilet 22. In some embodiments, surface 44 and/or surface 46 may have an arcuate configuration that conforms to that of bowl 26 such that the size and shape of recess 42 closely matches the size and shape of bowl 26.

Figure 5:
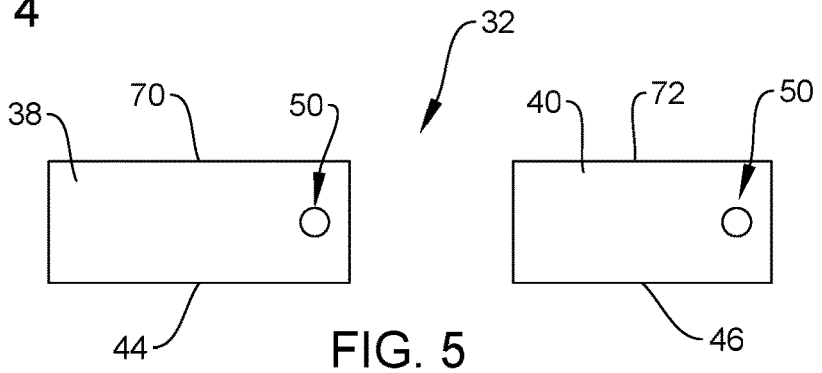
FIG. 5 is a top view of one embodiment of a component of the foot stool shown in FIG. 1, in accordance with the principles of the present disclosure.
Figure 6:
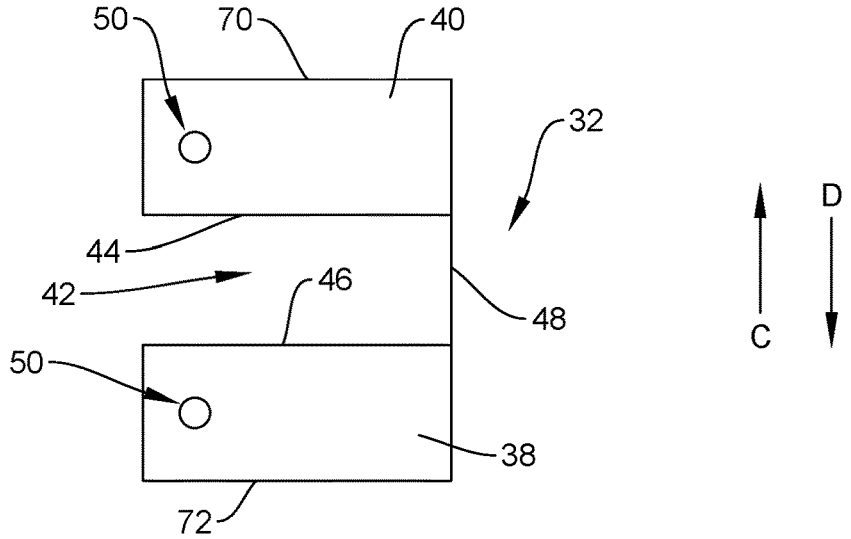
FIG. 6 is a top view of one embodiment of a component of the foot stool shown in FIG. 1, in accordance with the principles of the present disclosure.

In some embodiments, section 38 and section 40 are spaced apart and movable relative to one another before panel 32 is coupled to panel 34 via hinge 36, as shown in FIG. 5. In some embodiments wherein section 38 and section 40 are spaced apart and movable relative to one another before panel 32 is coupled to panel 34 via hinge 36, section 38 and section 40 are each integrally and/or monolithically formed. In some embodiments, section 38 is connected to section 40 by a link, such as, for example, a rail 48, as shown in FIG. 6. In some embodiments, sections 38, 40 are connected by rail 48 such that section 38 is immovable relative section 40 along rail 48. That is, sections 38, 40 each include an end that is permanently fixed and/or immovable relative to rail 48. In some embodiments wherein section 38 and section 40 are integrally and/or monolithically formed with rail 48. In some embodiments, sections 38, 40 are connected by rail 48 such that section 38 is movable relative section 40 along rail 48. For example, in some embodiments, sections 38, 40 each include a channel and rail 48 is slidably disposed in the channels of sections 48, 40 such that sections 38, 40 are each movable relative to one another along rail 48 in the direction shown by arrow C in FIG. 5 and/or the direction shown by arrow D in FIG. 5. That is, rail 48 slides within the channels of sections 48, 40 to move sections 48, 50 toward one another or away from one another to expand or contract the width of recess 42. It is envisioned that providing a means to adjust the width of recess 42 allows foot stool 24 to be used in conjunction with toilets having bowls of different widths.

Panel 32 includes a connector 50 configured to directly engage bowl 26 to couple foot stool 24 to toilet 22. That is, connector 50 directly engages bowl 26 to prevent relative movement between foot stool 24 and toilet 22 when foot stool 24 is in the expanded or unfolded configuration. In particular, connector 50 is configured to removably coupled base 28 to bowl 26 such that foot stool 24 can be directly connected to bowl 26 when foot stool 24 is in use in conjunction with toilet 22, and then disconnected and/or removed from bowl 26 following use of foot stool 24 in conjunction with toilet 22. In some embodiments, only one of sections 38, 40 includes one or more connector 50. In some embodiments, each of sections 38, 40 includes one or more connector 50, as shown in FIG. 2, for example. It is envisioned that connectors 50 may be selectively positioned on section 38 and/or section 40 to correspond to a contact point on bowl 26. That is, connectors 50 are positioned on panel 32 such that connectors will directly engage bowl 26 when foot stool 24 is in the expanded or unfolded configuration and bowl 26 is positioned in recess 42.

In some embodiments, connectors 50 each include a suction cup 52, as shown in FIG. 2, for example. In some embodiments, suction cups 52 are fixed relative to panel 32 such that suction cups 52 are immovable relative to section 38 and/or section 40. That is, suction cups 52 are each coupled to panel 32 such that a proximal surface 54 of each of suction cups 52 extends perpendicular to a top surface 56 of panel 32. In some embodiments, surfaces 54 define rims of suction cups 52. In some embodiments, suction cups 52 each maintain the perpendicular orientation of surface 54 relative to surface 56 until a force is applied to surface 54. The force may be provided by pushing suction cups 52 into bowl 26, for example. In some embodiments, suction cups 52 each include a base 58 and a cup 60 coupled to base 58. Cups 60 each include a surface 54. In some embodiments, bases 58 are each coupled directly to panel 32. In embodiments wherein surfaces 54 each maintain their perpendicular orientation relative to surface 56 until a force is applied to surface 54, bases 58 are permanently fixed and/or immovable relative to panel 32 such that only cups 60 deform or otherwise move relative to panel 32 when forces are applied to surfaces 54. In some embodiments, bases 58 each extend perpendicular to surface 56 before and after forces are applied to surfaces 54. In some embodiments, suction cups 52 can be variously connected with panel 32, such as, for example, monolithic, integral connection, frictional engagement, threaded engagement, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

Figure 12:
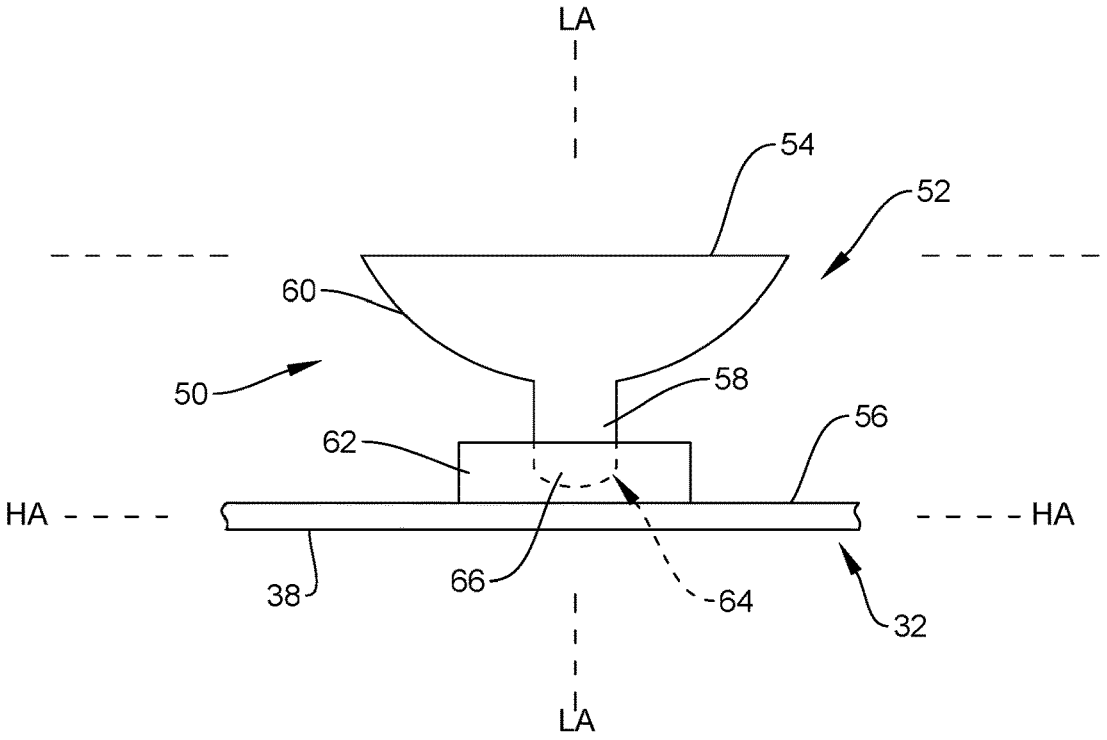
FIG. 12 is a side view of one embodiment of components of the foot stool shown in FIG. 1, in accordance with the principles of the present disclosure.
Figure 13:
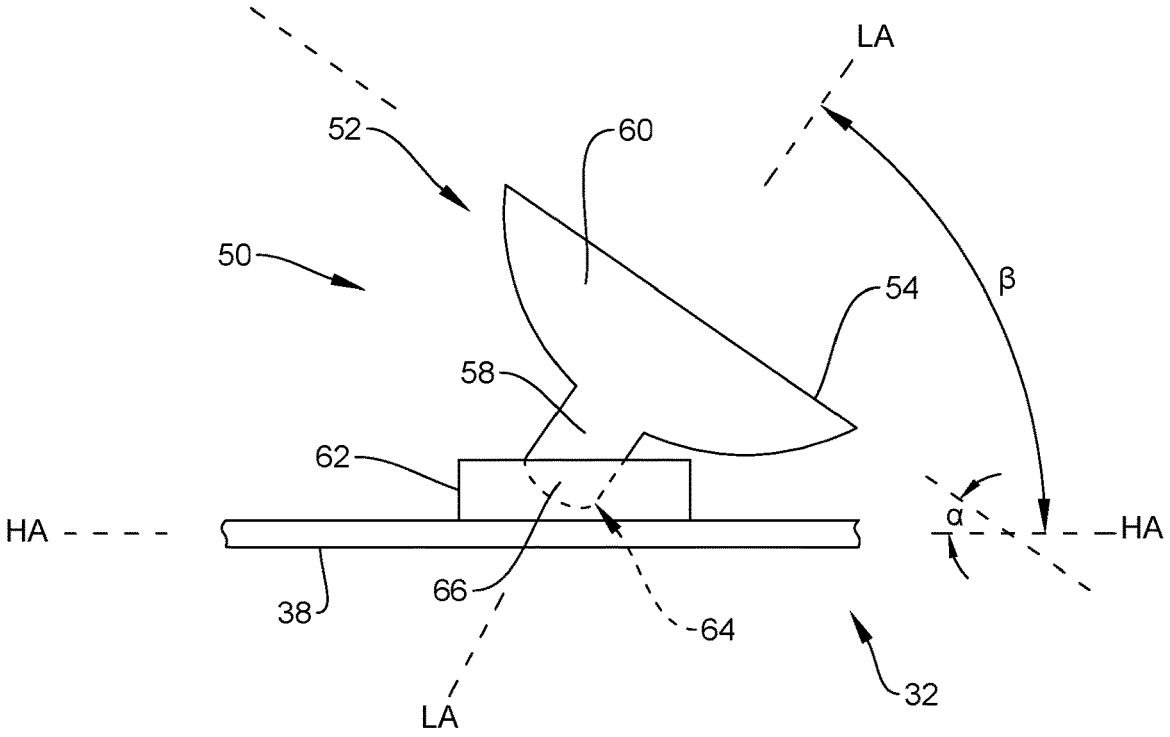
FIG. 13 is a side view of one embodiment of components of the foot stool shown in FIG. 1, in accordance with the principles of the present disclosure.

In some embodiments, suction cups 52 are rotatable relative to surface 56. For example, in some embodiments, suction cups 52 each include a mount 62 that is coupled to panel 32 such that mounts 62 are fixed and/or immovable relative to section 38 and/or section 40, as shown in FIGS. 12 and 13, for example. Mounts 62 each include a cavity 64. Ends 66 of bases 58 are positioned in cavities 64 such that inner surfaces that define cavities 64 and ends 66 define spheroidal joints, such as, for example, ball and socket joints. This allows suction cups 52 to each rotate relative to mounts 62, panel 32, section 38, section 40 and/or surface 56 between a first orientation in which surface 54 extends parallel to a horizontal axis HA defined by surface 56, as shown in FIG. 12 and a second orientation in which surface 54 extends at an angle $\alpha$ relative to axis HA, as shown in FIG. 13. In some embodiments, angle $\alpha$ is an acute angle. In some embodiments, angle $\alpha$ is between 5 degrees and 85 degrees. In some embodiments, angle $\alpha$ is between 15 degrees and 75 degrees. In some embodiments, angle $\alpha$ is between 25 degrees and 65 degrees. A longitudinal axis LA defined by base 58 extends perpendicular to axis HA when suction cup 52 is in the first orientation, as shown in FIG. 12. Axis LA extends at an angle $\beta$ when suction cup 52 is in the second orientation, as shown in FIG. 13. In some embodiments, angle $\beta$ is an acute angle. In some embodiments, angle $\beta$ is between 5 degrees and 85 degrees. In some embodiments, angle $\beta$ is between 15 degrees and 75 degrees. In some embodiments, angle $\beta$ is between 25 degrees and 65 degrees. In some embodiments, cavities 64 each are cup-like and have a hemispherical and/or substantially hemispherical configuration and ends 66 are each ball-like and have hemispherical and/or substantially hemispherical configuration to define the ball and socket joints. In some embodiments, mounts 62 can be variously connected with panel 32, such as, for example, monolithic, integral connection, frictional engagement, threaded engagement, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

Figure 14:
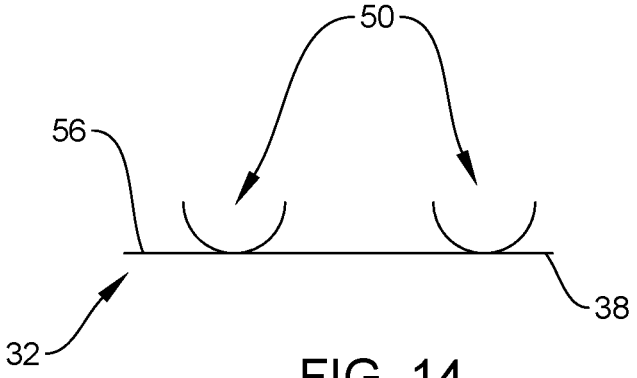
FIG. 14 is a side view of one embodiment of components of the foot stool shown in FIG. 1, in accordance with the principles of the present disclosure.
Figure 15:
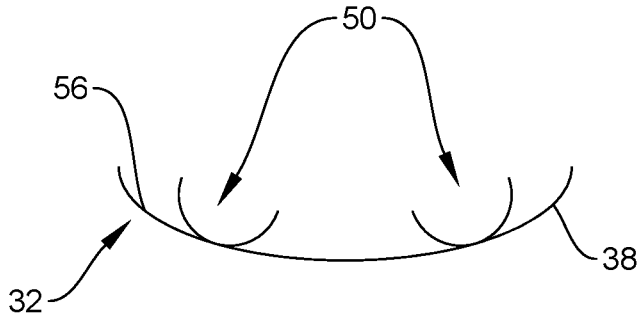
FIG. 15 is a side view of one embodiment of components of the foot stool shown in FIG. 1, in accordance with the principles of the present disclosure.
Figure 16:
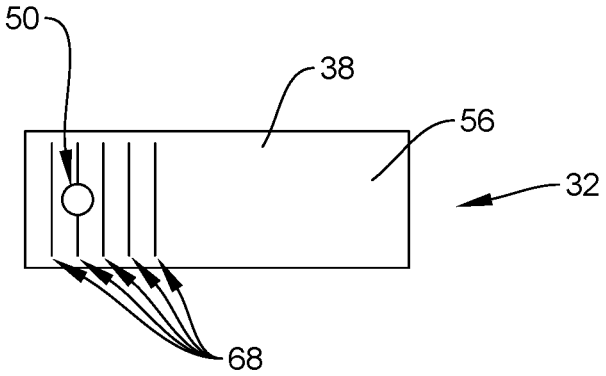
FIG. 16 is a side view of one embodiment of components of the foot stool shown in FIG. 1, in accordance with the principles of the present disclosure.

In some embodiments, panel 32 is made of a hard and/or rigid material. In some embodiments, panel 32 is made of a material that cannot bend and/or deform without breaking. In some embodiments, panel 32 is configured to flex, deform and/or bend to facilitate direct engagement of connectors 50 with an outer surface of bowl 26. For example, it may be desirable for at least a portion of panel 32 to assume an arcuate configuration, such as, for example, a concave configuration to accommodate and/or match a toilet bowl, such as, for example, bowl 26 that is convexly curved. As such, in some embodiments, panel 32 is configured to move from a planar orientation, as shown in FIG. 14, to an arcuate orientation, such as, for example, a concave orientation, as shown in FIG. 15. In some embodiments, panel 32 is made from a flexible and/or deformable material to allow panel to move between the planar and arcuate orientations. In some embodiments, panel 32 is made from a hard and/or rigid material and/or a material that cannot bend and/or deform without breaking and moves between the planar and arcuate orientations due to one or a plurality of recesses, such as, for example, grooves 68, as shown in FIG. 16. Grooves 68 each have a length along a width of panel 32, such as, for example, along a width of section 38 or a width of section 40. In some embodiments, grooves 68 each have the same length. In some embodiments, grooves 68 each have a different length. In some embodiments, grooves 68 are uniformly spaced apart from one another. In some embodiments, grooves 68 of section 38 are positioned between surface 44 and an opposite outer surface 70 of section 38 such that grooves 68 of section 38 are positioned between surfaces 46, 70 without extending through surfaces 44, 70, as shown in FIG. 16, and grooves 68 of section 40 are positioned between surface 46 and an opposite outer surface 72 of section 40 such that grooves 68 of section 40 are positioned between surfaces 46, 72 without extending through surfaces 46, 72. In some embodiments, grooves 68 of section 38 extend through surfaces 44, 70 and grooves 68 of section 40 extend through surfaces 46, 72. In some embodiments, at least one of grooves 68 extends on either side of one of connectors 50, as shown in FIG. 16. In some embodiments, grooves 68 are each spaced apart and/or not in alignment with any of connectors 50.

Figure 17:
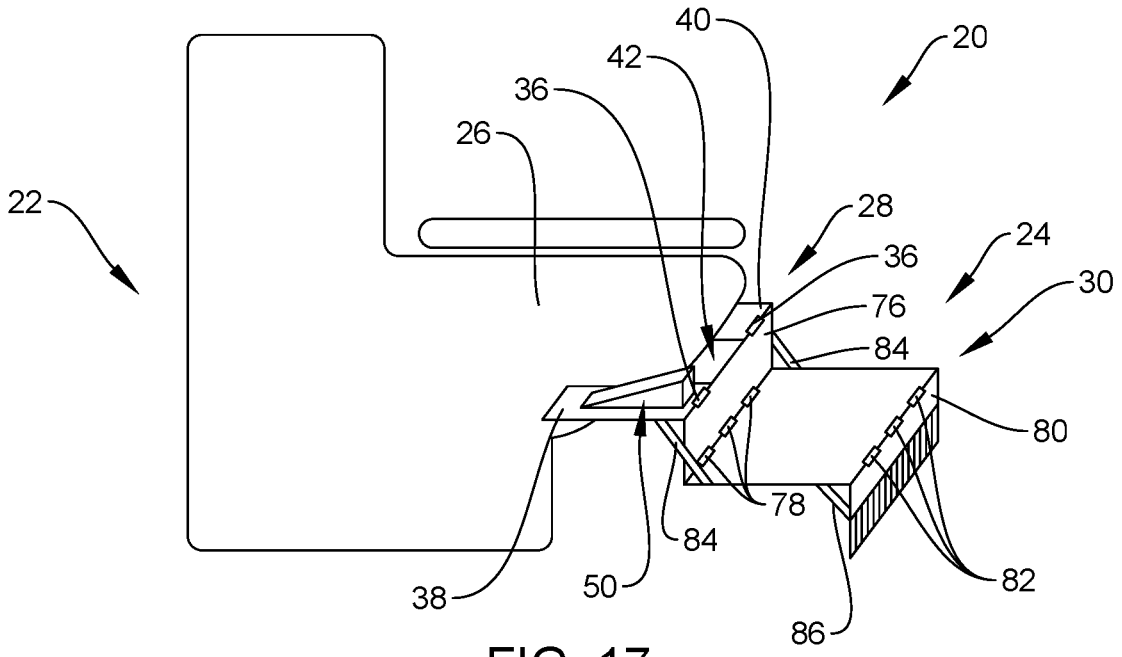
FIG. 17 is a perspective view of one embodiment of the foot stool shown in FIG. 1, in accordance with the principles of the present disclosure.
Figure 18:
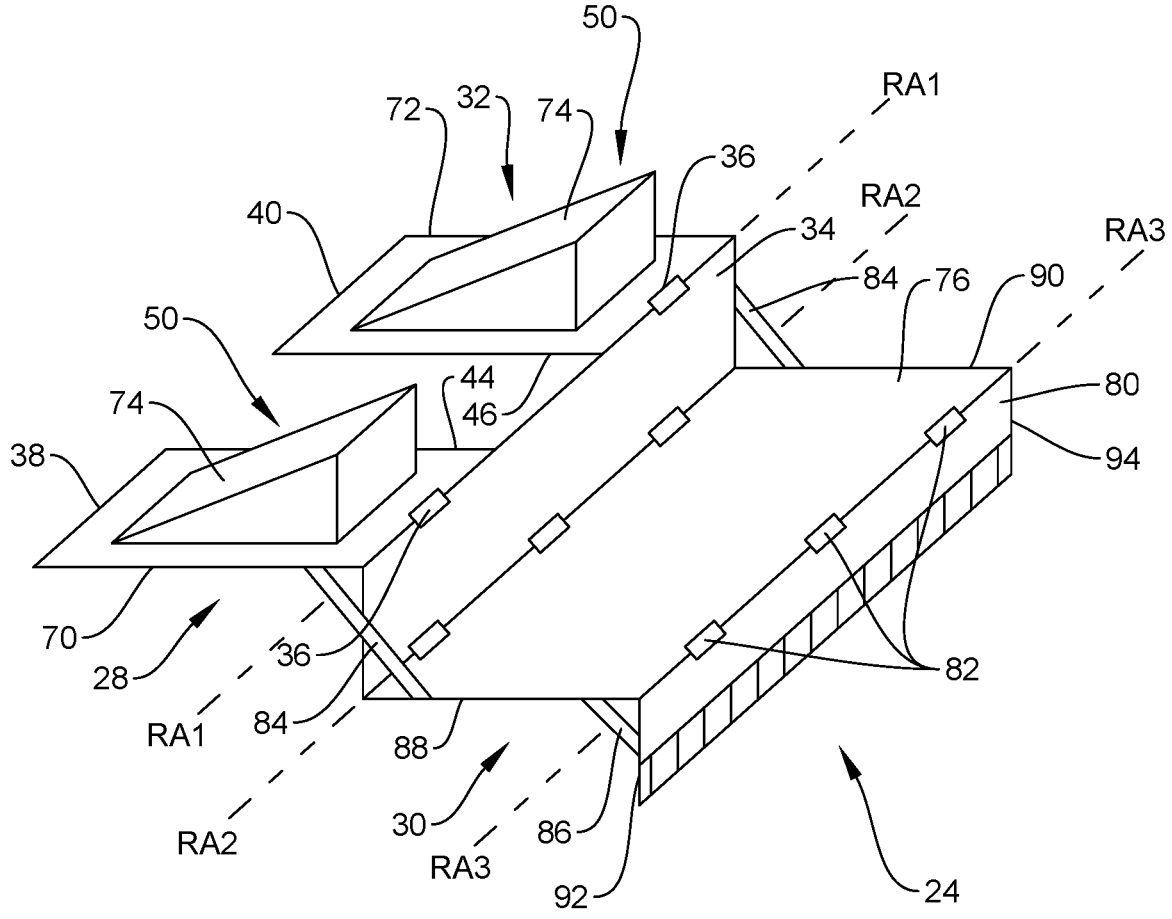
FIG. 18 is a perspective view of one embodiment a foot stool system including a toilet and a foot stool coupled to the toilet, in accordance with the principles of the present disclosure.

In some embodiments, connectors 50 include a substrate 74 that is configured to adhere directly to bowl 26 to prevent relative movement between foot stool 26 and toilet 22, as shown in FIGS. 17 and 18. In some embodiments, substrate 74 is configured to removably coupled base 28 to bowl 26 such that foot stool 24 can be directly connected to bowl 26 when foot stool 24 is in use in conjunction with toilet 22, and then disconnected and/or removed from bowl 26 following use of foot stool 24 in conjunction with toilet 22. That is, substrate 74 will adhere directly to bowl 26 when a force is applied, such as, for example, a force that pushes substrate 74 directly against an outer surface of bowl 26, and then release from bowl 26 when substrate 74 is pulled away from bowl 26. In some embodiments, sections 38, 40 each include one substrate 74. However, it is envisioned that section 38 and/or section 40 may each include one or a plurality of substrates 74. In some embodiments, substrates are wedge-shaped, as shown in FIG. 18. In some embodiments, substrates 74 are variously shaped, such as, for example, oval, oblong, triangular, square, polygonal, irregular, uniform, non-uniform, offset, staggered, undulating, arcuate, variable and/or tapered. In some embodiments, substrates 74 are gels. In some embodiments, substrates 74 are each made from a deformable and/or elastomeric material that is incapable of adhering to bowl 26 and a material that is configured to adhere to bowl 26 is applied to a top surface of substrate 74 such that the material that is configured to adhere to bowl 26 directly engages bowl 26 when foot stool 24 is coupled to toilet 22. It is envisioned that that the material that is configured to adhere to bowl 26 may be in the form of a liquid adhesive, a gel adhesive, a solid adhesive, double sided tape, etc.

Figure 7:
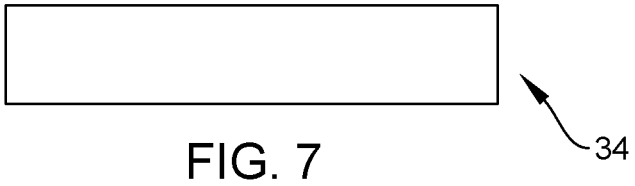
FIG. 7 is a top view of one embodiment of a component of the foot stool shown in FIG. 1, in accordance with the principles of the present disclosure.

Referring back to FIG. 7, one embodiment of panel 34 is shown. In some embodiments, panel 34 is integrally/and/or monolithically formed. While panel 34 is shown in FIG. 7 as having a rectangular configuration, panel 34 may variously shaped, such as, for example, oval, oblong, triangular, square, polygonal, irregular, uniform, non-uniform, offset, staggered, undulating, arcuate, variable and/or tapered. In some embodiments, panel 34 is made of a hard and/or rigid material. In some embodiments, panel 34 is made of a material that cannot bend and/or deform without breaking. In some embodiments, panel 34 is configured to flex, deform and/or bend. In some embodiments, panel 34 and panel 32 are made from different materials. In some embodiments, panel 34 and panel 32 are made from the same material or materials.

Step 30 includes a third panel 76 that is rotatably coupled to panel 34 by a second hinge 78. Hinge 78 connects panel 76 with panel 34 such that panel 76 is rotatable relative to panel 34 about a rotation axis RA2 defined by hinge 78, as shown in FIG. 2, for example. In particular, panel 76 is rotatable relative to panel 34 via hinge 78 in a first rotational direction about axis RA2, such as, for example, the direction shown by arrow A in FIG. 3 and in an opposite second rotational direction about axis RA2, such as, for example, the direction shown by arrow B in FIG. 3 to move foot stool 24 between the expanded or unfolded configuration, as shown in FIGS. 2 and 3, and the unexpanded or folded configuration, as shown in FIG. 4. In some embodiments, hinge 78 includes only one hinge. In some embodiments, hinge 78 includes a plurality of hinges. In some embodiments, hinge 78 includes a plurality of spaced apart hinges. In some embodiments wherein hinge 78 includes a plurality of hinges, hinges 36 are uniformly spaced apart from one another. In some embodiments, panel 76 is spaced apart from panel 34 such that no portion of panel 76 directly engages panel 34 and panel 76 is connected to panel 34 only by hinge 78. In some embodiments, panel 76 directly engages panel 34 and panel 76 and is further connected to panel 34 by hinge 78. In some embodiments, hinge 78 can be variously connected with panel 76 and/or panel 34, such as, for example, monolithic, integral connection, frictional engagement, threaded engagement, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

Figure 8:
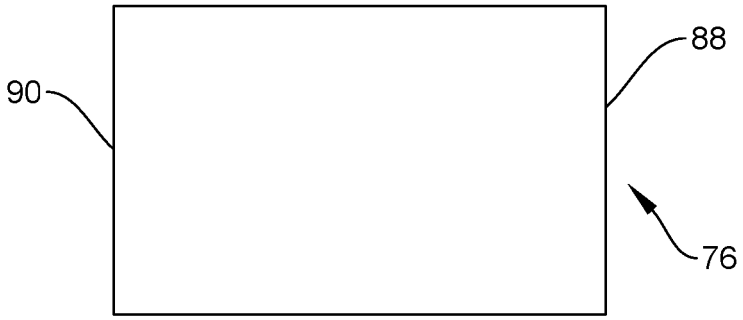
FIG. 8 is a top view of one embodiment of a component of the foot stool shown in FIG. 1, in accordance with the principles of the present disclosure.

One embodiment of panel 76 is shown in FIG. 8. In some embodiments, panel 76 is integrally/and/or monolithically formed. While panel 76 is shown in FIG. 8 as having a rectangular configuration, panel 76 may variously shaped, such as, for example, oval, oblong, triangular, square, polygonal, irregular, uniform, non-uniform, offset, staggered, undulating, arcuate, variable and/or tapered. In some embodiments, panel 76 is made of a hard and/or rigid material. In some embodiments, panel 76 is made of a material that cannot bend and/or deform without breaking. In some embodiments, panel 76 is configured to flex, deform and/or bend. In some embodiments, panel 34 and panel 76 are made from different materials. In some embodiments, panel 34 and panel 76 are made from the same material or materials.

Step 30 includes a fourth panel 80 that is rotatably coupled to panel 76 by a third hinge 82. Hinge 82 connects panel 76 with panel 80 such that panel 76 is rotatable relative to panel 80 about a rotation axis RA3 defined by hinge 82, as shown in FIG. 2, for example. In particular, panel 76 is rotatable relative to panel 80 via hinge 82 in a first rotational direction about axis RA3, such as, for example, the direction shown by arrow A in FIG. 3 and in an opposite second rotational direction about axis RA3, such as, for example, the direction shown by arrow B in FIG. 3 to move foot stool 24 between the expanded or unfolded configuration, as shown in FIGS. 2 and 3, and the unexpanded or folded configuration, as shown in FIG. 4. In some embodiments, hinge 82 includes only one hinge. In some embodiments, hinge 82 includes a plurality of hinges. In some embodiments, hinge 82 includes a plurality of spaced apart hinges. In some embodiments wherein hinge 82 includes a plurality of hinges, hinges 82 are uniformly spaced apart from one another. In some embodiments, panel 76 is spaced apart from panel 80 such that no portion of panel 76 directly engages panel 80 and panel 76 is connected to panel 80 only by hinge 82. In some embodiments, panel 76 directly engages panel 80 and panel 76 and is further connected to panel 80 by hinge 82. In some embodiments, hinge 82 can be variously connected with panel 76 and/or panel 80, such as, for example, monolithic, integral connection, frictional engagement, threaded engagement, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

Figure 9:
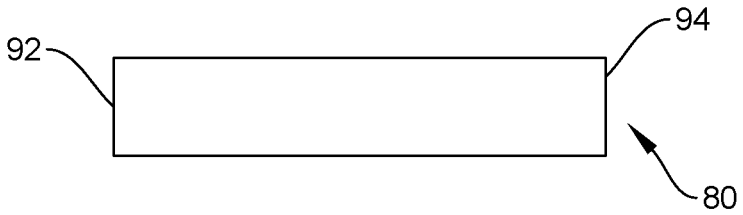
FIG. 9 is a top view of one embodiment of a component of the foot stool shown in FIG. 1, in accordance with the principles of the present disclosure.

One embodiment of panel 80 is shown in FIG. 9. In some embodiments, panel 80 is integrally/and/or monolithically formed. While panel 80 is shown in FIG. 9 as having a rectangular configuration, panel 8—may variously shaped, such as, for example, oval, oblong, triangular, square, polygonal, irregular, uniform, non-uniform, offset, staggered, undulating, arcuate, variable and/or tapered. In some embodiments, panel 80 is made of a hard and/or rigid material. In some embodiments, panel 80 is made of a material that cannot bend and/or deform without breaking. In some embodiments, panel 80 is configured to flex, deform and/or bend. In some embodiments, panel 80 and panel 76 are made from different materials. In some embodiments, panel 80 and panel 76 are made from the same material or materials.

Figure 10:
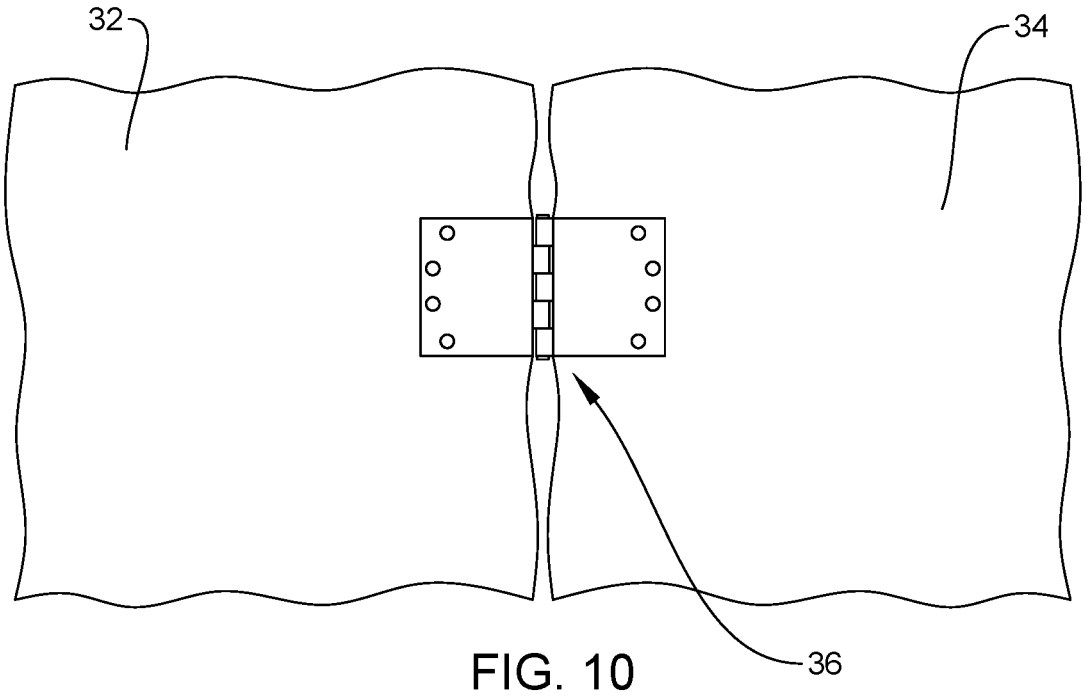
FIG. 10 is a top view of one embodiment of components of the foot stool shown in FIG. 1, in accordance with the principles of the present disclosure.
Figure 11:
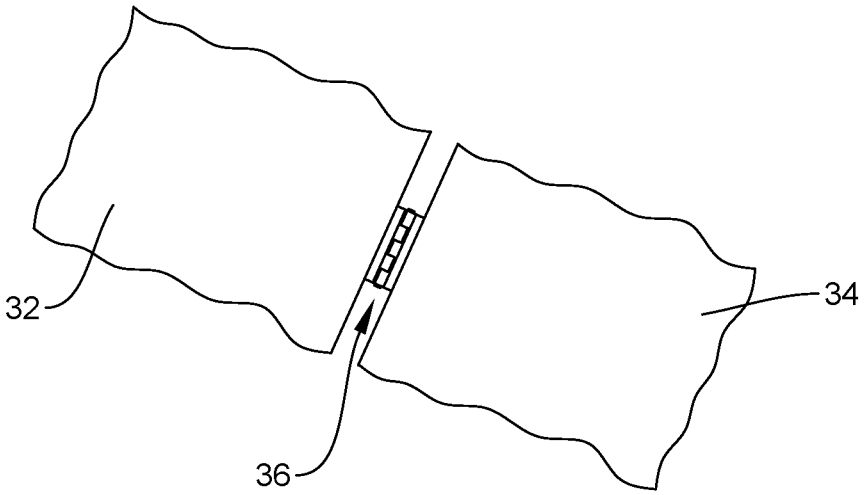
FIG. 11 is a top view of one embodiment of components of the foot stool shown in FIG. 1, in accordance with the principles of the present disclosure.

In some embodiments, hinge 36, hinge 78 and/or hinge 82 is a butt hinge, as shown in FIG. 10, for example. While FIG. 10 shows hinge 36 connecting panels 32, 34, it is envisioned that the hinge in FIG. 10 may be used as hinge 78 to connect panels 34, 76 and/or as hinge 82 to connect panels 76, 80. In some embodiments, hinge 36, hinge 78 and/or hinge 82 is a living hinge, as shown in FIG. 11, for example. While FIG. 11 shows hinge 36 connecting panels 32, 34, it is envisioned that the hinge in FIG. 11 may be used as hinge 78 to connect panels 34, 76 and/or as hinge 82 to connect panels 76, 80.

In operation and use, foot stool 24 is removed from a closet or other storage area with foot stool 24 in the unexpanded or folded configuration, shown in FIG. 4. When foot stool 24 is in the unexpanded or folded configuration, panels 32, 34, 76, 80 extend parallel to one another, as shown in FIG. 4. In some embodiments, panels 32, 34, 76, 80 extend substantially parallel to one another when foot stool 24 is in the unexpanded or folded configuration, such as, for example, within 1 degree to 5 degrees of parallel or within 1 to 10 degrees of parallel. Prior to coupling foot stool 24 to toilet 22, foot stool 24 is moved from the unexpanded or folded configuration to the expanded or unfolded configuration, shown in FIGS. 2 and 3, by rotating panel 80 relative to panel 76 about axis RA3 via hinge 80 in the direction shown by arrow B in FIG. 3, rotating panel 76 relative to panel 34 about axis RA2 via hinge 78 in the direction shown by arrow A in FIG. 3 and rotating panel 34 relative to panel 32 about axis RA1 via hinge 36 in the direction shown by arrow B in FIG. 3. When foot stool 24 is in the expanded or unfolded configuration, panel 32 extends parallel to panel 76 and panel 34 extends parallel to panel with panels 32, 76 extending perpendicular to panels 34, 80. In some embodiments, panel 32 extends parallel to panel 76 and panel 34 extends parallel to panel 80 when foot stool 24 is in the expanded or unfolded configuration, with panels 32, 76 extending substantially perpendicular to panels 34, 80, such as, for example within 1 degree to 5 degrees of perpendicular or within 1 degree to 10 degrees of perpendicular.

Once foot stool 24 is in the expanded or unfolded configuration, foot stool 24 can be coupled directly to toilet 22 by positioning foot stool 24 relative to toilet 22 such that bowl 22 is positioned within recess 42 and connectors 50 are positioned adjacent to bowl 26. Connectors 50 are coupled to bowl 26 by pushing panel 32, such as, for example, section 38 and/or section 40, upwardly such that connectors 50 directly engage bowl 26 to prevent relative movement between foot stool 24 and toilet 22.

Following use of foot stool 24 with toilet 22, foot stool 24 can be removed from toilet 22 for cleaning and/or storage, for example. Foot stool 24 can be removed from toilet by pulling panel 32, such as, for example, section 38 and/or section downwardly and/or away from bowl 26 such that connectors 50 disengage bowl 26. Foot stool 24 can then be moved from the expanded or unfolded configuration to the unexpanded or folded configuration by rotating panel 80 relative to panel 76 about axis RA3 via hinge 80 in the direction shown by arrow A in FIG. 3, rotating panel 76 relative to panel 34 about axis RA2 via hinge 78 in the direction shown by arrow B in FIG. 3 and rotating panel 34 relative to panel 32 about axis RA1 via hinge 36 in the direction shown by arrow A in FIG. 3. Once foot stool 24 is in the unexpanded or folded configuration, foot stool 24 can readily be stored and/or concealed.

In some embodiments, foot stool 24 includes a first strap 84 having a first end connected to panel 32 and an opposite second end connected to panel 76 and a second strap 86 having a first end connected to panel 76 and an opposite second end coupled to panel 80. Straps 84, 86 are configured to prevent over rotation of panels 32, 34, 76, 80 when foot stool 24 is in the expanded or unfolded configuration. For example, when foot stool 24 is in the expanded or unfolded configuration, strap 84 prevents rotation of panel 32 relative to panel 76 in the direction shown by arrow A in FIG. 3 to maintain panel 32 in a parallel or substantially parallel orientation relative to panel 76 when foot stool 24 is in the expanded or unfolded configuration. That is, strap 84 prevents rotation of panel 32 relative to panel 76 in the direction shown by arrow A in FIG. 3 when foot stool 24 is in the expanded or unfolded configuration, but allows rotation of panel 32 relative to panel 76 in the direction shown by arrow B in FIG. 3 when foot stool 24 is in the expanded or unfolded configuration. Strap 86 prevents rotation of panel 80 relative to panel 76 in the direction shown by arrow B in FIG. 3 when foot stool 24 is in the expanded or unfolded configuration. That is, strap 86 prevents rotation of panel 80 relative to panel 76 in the direction shown by arrow B in FIG. 3 when foot stool 24 is in the expanded or unfolded configuration, but allows rotation of panel 80 relative to panel 76 in the direction shown by arrow A in FIG. 3 when foot stool 24 is in the expanded or unfolded configuration. In some embodiments, strap 84 includes a pair of straps 84, wherein one of straps 84 is coupled to surface 70 and an end surface 88 of panel 76 and another one of straps 84 is coupled to surface 72 and an opposite end surface 90 of panel 76. In some embodiments, strap 86 includes a pair of straps 86, wherein one of straps 86 is coupled to surface 70 and an end surface 92 of panel 80 and another one of straps 86 is coupled to surface 72 and an opposite end surface 94 of panel 80. In some embodiments, straps 84, 86 can be variously connected with panels 32, 76, 80, such as, for example, monolithic, integral connection, frictional engagement, threaded engagement, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts. In some embodiments, strap 84 and/or strap 86 is/are made of an inelastic material, such as, for example, a fabric material and/or an inelastic polymer material. In some embodiments, strap 84 and/or strap 86 is/are made of an elastic material.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A foot stool comprising:

a base comprising a first panel and a second panel rotatably coupled to the first panel;

a step comprising a third panel rotatably coupled to the second panel and a fourth panel rotatably coupled to the third panel; and a connector coupled to the first panel, the connector comprising a suction cup, the connector being configured for coupling the base to a toilet bowl, wherein the foot stool is movable from a first configuration in which the first and third panels extend substantially parallel to one another and the second and fourth panels each extend transverse to the first and third panels and a second configuration in which the panels each extend substantially parallel to one another.

2. The foot stool recited in claim 1, wherein the second and fourth panels each extend substantially parallel to one another when the foot stool is in the first configuration.

3. The foot stool recited in claim 1, wherein the first panel is connected to the second panel by a first hinge, the second panel is connected to the third panel by a second hinge and the third panel is connected to the fourth panel by a third hinge.

4. The foot stool recited in claim 3, wherein at least one of the hinges is a butt hinge.

5. The foot stool recited in claim 3, wherein at least one of the hinges is a living hinge.

6. The foot stool recited in claim 1, wherein the connector comprises a mount coupled directly to the first panel and the suction cup rotatably coupled to the mount.

7. The foot stool recited in claim 6, wherein the suction cup forms a ball and socket joint with the mount.

8. The foot stool recited in claim 1, further comprising a first strap connecting the first and third panels and a second strap connecting the third and fourth panels.

9. The foot stool recited in claim 8, wherein the straps are configured to maintain the foot stool in the first configuration.

10. The foot stool recited in claim 1, further comprising spaced apart first straps each connecting the first and third panels and spaced apart second straps each connecting the third and fourth panels, the straps being configured to maintain the foot stool in the first configuration.

11. The foot stool recited in claim 1, wherein the first panel comprises spaced apart first and second sections that are each coupled to the second panel.

12. The foot stool recited in claim 11, wherein the suction cup is coupled to the first section and a second connector is coupled to the second section.

13. The foot stool recited in claim 12, wherein the second connector is a suction cup, and each connector further comprises a mount coupled directly to the first panel, and each suction cup is rotatably connected to the respective mount such that a ball and socket joint is formed.

14. The foot stool recited in claim 1, wherein the first panel comprises a bendable material configured to conform to a shape of the toilet bowl.

15. A foot stool system comprising:

a toilet bowl; and a foot stool comprising:

a base comprising a first panel and a second panel rotatably coupled to the first panel by at least one first hinge, the first panel comprising spaced apart first and second sections that are each coupled to the second panel, a step comprising a third panel rotatably coupled to the second panel by at least one second hinge and a fourth panel rotatably coupled to the third panel by at least one third hinge, spaced apart first straps each connecting the first and third panels and spaced apart second straps each connecting the third and fourth panels, and a first connector coupled to the first section and a second connector coupled to the second section, the connectors each provisionally coupling the base to the toilet bowl, wherein the connectors each comprise a mount coupled directly to the first panel and a suction cup rotatably coupled to the mount such that the suction cups each form a ball and socket joint with one of the mounts, wherein the foot stool is movable from a first configuration in which the first and third panels extend substantially parallel to one another and the second and fourth panels each extend transverse to the first and third panels and a second configuration in which the panels each extend substantially parallel to one another, the foot stool being configured to move between the first and second configurations when the base is uncoupled from the toilet, and wherein the straps are configured to maintain the foot stool in the first configuration.

16. A foot stool comprising:

a base comprising a first panel and a second panel rotatably coupled to the first panel;

a step comprising a third panel rotatably coupled to the second panel and a fourth panel rotatably coupled to the third panel;

a first strap connecting the first and third panels and a second strap connecting the third and fourth panels; and a connector coupled to the first panel, the connector being configured for coupling the base to a toilet bowl, wherein the foot stool is movable from a first configuration in which the first and third panels extend substantially parallel to one another and the second and fourth panels each extend transverse to the first and third panels and a second configuration in which the panels each extend substantially parallel to one another.

17. The foot stool recited in claim 16, wherein the straps are configured to maintain the foot stool in the first configuration.

18. The foot stool recited in claim 16, wherein:

the first panel is connected to the second panel by a first hinge, the second panel is connected to the third panel by a second hinge and the third panel is connected to the fourth panel by a third hinge; and wherein at least one of the hinges is a butt hinge.

19. The foot stool recited in claim 16, wherein the first panel comprises spaced apart first and second sections that are each coupled to the second panel.

* * * * *